United States Patent [19]

Ebersberger

[11] Patent Number: 4,891,832

[45] Date of Patent: Jan. 2, 1990

[54] ROTATING ANODE X-RAY TUBE

[75] Inventor: Hans Ebersberger, Kotzenaurach, Fed. Rep. of Germany

[73] Assignee: Siemens Aktiengesellschaft, Berlin and Munich, Fed. Rep. of Germany

[21] Appl. No.: 210,385

[22] Filed: Jun. 23, 1988

[30] Foreign Application Priority Data

Jul. 22, 1987 [DE] Fed. Rep. of Germany ... 8710059[U]

[51] Int. Cl.[4] ..... H01J 35/10

[52] U.S. Cl. ..... 378/132; 378/125; 378/101

[58] Field of Search ..... 378/132, 125, 101, 117

[56] References Cited

U.S. PATENT DOCUMENTS 4,167,671 9/1979 Boden et al. .
4,468,801 8/1984 Sudo et al. ..... 378/132
4,583,794 4/1986 Takahara et al. ..... 378/132
4,628,522 12/1986 Ebersberger .

FOREIGN PATENT DOCUMENTS 0071456 7/1982 European Pat. Off. .
1094465 11/1953 France .

*Primary Examiner*—Carolyn E. Fields
*Assistant Examiner*—David P. Porta
*Attorney, Agent, or Firm*—Hill, Van Santen, Steadman & Simpson

[57] ABSTRACT

An x-ray tube has an evacuated housing with a cathode and a rotating anode therein, the rotating anode including a drive shaft normally supported during operation by a magnetic bearing arrangement, but having mechanical bearings attached to the housing by which the shaft is supported if the anode "drops" during operation. A disengageable contact is provided which, when closed, completes a circuit for supplying high voltage to the anode. A displaceable actuator extends into the evacuated housing for making and breaking the contact, the actuator being sealed air-tight within the housing by a spring bellows. The actuator has a guide element disposed outside of the evacuated housing, which permits the guide element to be lubricated as needed. A locking element is provided which is engageable with the guide element to hold the anode shaft, and thus the anode, in place against the mechanical bearings during transport of the x-ray tube.

13 Claims, 1 Drawing Sheet

ROTATING ANODE X-RAY TUBE

BACKGROUND OF THE INVENTION

1. Field of the Invention

The present invention is directed to a rotating anode x-ray tube having a magnetic bearing arrangement used during operation of the tube, and a mechanical bearing arrangement for supporting the anode shaft in the event of the anode "dropping" and a magnetically actuatable contact for making and breaking a circuit to provide high voltage to the anode.

2. Description of the Prior Art

A rotating anode x-ray tube is disclosed in U.S. Pat. No. 4,167,671 having a cathode and the rotating anode contained in an evacuated housing, the rotating anode having a drive shaft which is magnetically seated within the housing during normal operation of the x-ray tube. The housing is also provided with mechanical bearings which support the shaft of the anode in the event of an anode "drop" or when the magnetic bearing arrangement is shut off when the tube is not in use. This known x-ray tube also has a magnetically actuatable anode contact for making and breaking the circuit which provides high voltage to the anode.

Mechanical bearings which are used for supporting the shaft of the rotating anode in x-ray tubes of this type must necessarily exhibit a certain play or slack to compensate for thermal expansion of the components during operation. The mechanical bearings in x-ray tubes of the type described above, which are used as a back-up in the event of failure or shut down of the magnetic bearing arrangement, intentionally are spaced from the anode shaft, so as not to interfere with the rotation of the drive shaft during normal operation, during which time the shaft is supported by the magnetic bearing arrangement. Such mechanical bearings only intercept the rotating system when the magnetic support ceases, i.e., when the anode "drops." When the x-ray tube of the type is shut down, therefore, the play in the bearings is considerable and, particularly during transport of a rotating anode x-ray tube of this type, the rotating anode is not rigidly held, but can move about inside the housing, possibly damaging the anode or other components.

As noted above, the voltage supply in the vacuum tube described in U.S. Pat. No. 4,167,671 is through a magnetically actuatable anode contact which connects the anode to one pole of a high voltage supply. This anode contact includes a male member which is guided in a bore disposed inside the evacuated housing. A slip contact is made between the surfaces of the male member and the bore, however, because the bore is located inside the evacuated housing, the surfaces cannot be lubricated, otherwise the vacuum would be contaminated.

A rotating anode x-ray tube is disclosed in European Application No. 0 154 699, corresponding to U.S. Pat. No. 4,628,522, having a magnetic bearing arrangement wherein the mechanical intercept bearings are rigidly connected to the housing, and the shaft has a pair of rings thereon. The rings engage the ball race of the bearing when the rotating anode drops. Again, however, this known mechanical bearing has a certain amount of play, so that the rotating anode in this device also knocks against the other components when the magnetic bearing is off.

SUMMARY OF THE INVENTION

It is an object of the present invention to provide a rotating anode x-ray tube having an anode contact which makes and breaks the supply of high voltage to the anode by displacement of a contact actuator, having a guide for the contact actuator disposed outside of the evacuated housing to permit access thereto for lubrication, without disturbing the vacuum.

A further object of the present invention is to provide such a rotating anode x-ray tube with means for locking the anode shaft in place when the magnetic bearing arrangement is off.

The above objects are achieved in accordance with the principles of the present invention in a rotating anode wherein the displaceable contact actuator is connected to the armature of a solenoid with the contact actuator being sealed within the evacuated housing by a spring bellows, the contact actuator further having a guide element disposed outside of the evacuated housing. The guide element has a surface which glides against a surface attached to the outside of the housing, so that the gliding surfaces can be lubricated without disturbing the vacuum. The displacement of the contact actuator also occurs outside of the housing by means of the solenoid.

The glide element may be in the form of a cylindrical collar attached to the contact actuator, the outside cylindrical surface of the collar being received in a tube attached to the evacuated housing.

Additionally, a locking means is provided which acts on the collar to press the contact actuator, and thus the anode shaft, firmly against the mechanical bearings within the housing when the x-ray tube is to be transported. The play between the bearings which is normally present is thus eliminated, so that the anode cannot move about within the housing during transport.

A reliable central locking is achieved in an embodiment of the rotating anode x-ray tube wherein the mechanical bearing which presses against the drive shaft, and faces toward the contact actuator, has a slanted surface which can be brought into engagement with a similarly slanted surface of the contact actuator. The force acting on the contact actuator caused by the pressure differential is opposed by a spring disposed between the housing and the collar. The locking mechanism also includes a screw acting radially relative to the drive shaft which acts on the contact actuator to move the contact actuator into a fixed position against the mechanical bearing. The tube which receives the collar attached to the contact actuator may have an inwardly extending flange thereon, through which the screw is received in a threaded bore to act upon the collar within the tube.

Contact pressure between the contact actuator and the rotating tube can be maintained low by providing a resiliently seated contact pin in the bottom of the anode shaft which engages the contact actuator.

DESCRIPTION OF THE PREFERRED EMBODIMENTS

Figure 1:
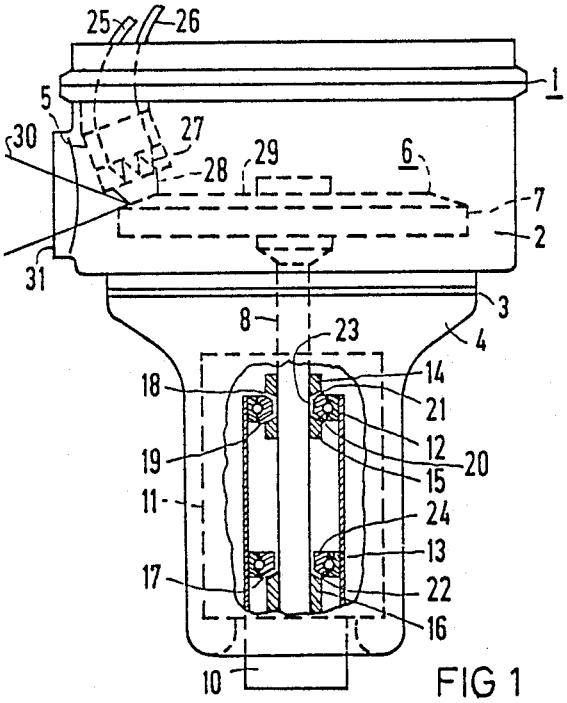
FIG. 1 is a side view, partly broken away and partly in section, of a rotating anode x-ray tube constructed in accordance with the principles of the present invention.

A rotating anode x-ray tube 1 is shown in FIG. 1 having an evacuated housing including a metal casing 2 having an open side fused vacuum-tight with a glass bulb 4. A cathode 5 and an anode assembly 6 are disposed inside of the housing in a known manner. The anode assembly 6 includes an anode dish 7 and a drive shaft 8. The drive shaft 8 is received in a tubular connection element 10, which terminates the evacuated housing at the bottom, and is glazed in the glass bulb 4. A rotor 11 is also attached to the drive shaft 8 for driving the anode system 6 in combination with a stator (not shown) which is attached to the exterior of the glass bulb 4.

To place the anode assembly 6 in rotation, a magnetic bearing arrangement (not shown) is provided in a known manner. The magnetic bearing system supports the anode shaft 8 during normal operation. Additional mechanical bearings are provided, such as ball bearings 12 and 13 attached to the connecting element 10, which intercept the shaft 8 when the anode "drops" either by failure of the magnetic bearing system, or when the magnetic bearing system is shut down. For this purpose, the shaft 8 has rings 14 and 15 disposed on opposite sides of the bearing 12, and a ring 16 disposed adjacent the lower bearing 13. These rings have respective beveled surfaces 17, 18 and 19 facing the respective bearings 12 and 13. The inner ball race 23 of the bearing 12 has correspondingly beveled surfaces 20 and 21, and the inner ball race 24 of the bearing 13 has a correspondingly beveled surface 22. During operation, i.e., when the shaft 8 is supported by the magnetic bearing system, a clearance between the beveled surfaces of, for example, 0.25 mm is maintained.

The anode assembly 6 is placed in rotation in a known manner, at which time a filament voltage for the cathode 5 is applied across lines 25 and 26, and an accelerating voltage is applied between the line 25 and the connecting element 10, so that an electron beam 28 emerges from the cathode coil 27 as the electrons are boiled off of the coil. The electron beam 28 is incident on a surface 29 of the anode dish 7, generating an x-ray beam 30 which emerges from the x-ray tube 1 through a window 41.

Figure 2:
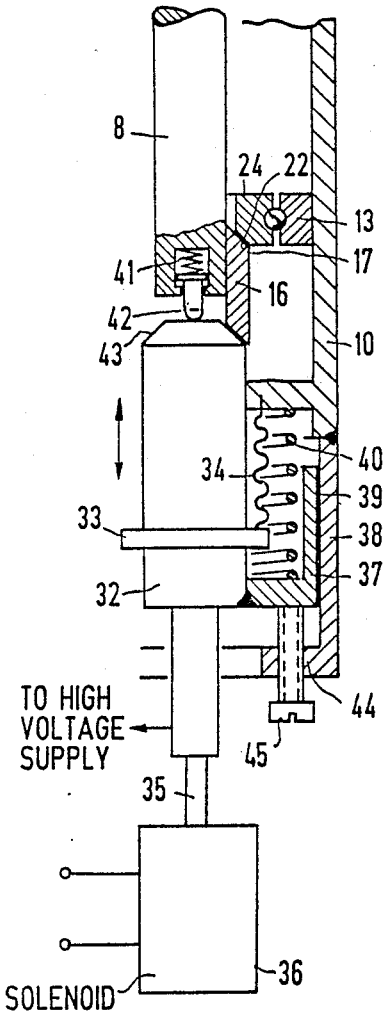
FIG. 2 is a side sectional view of a portion of the rotating anode x-ray tube of FIG. 1 showing the components in a locked position.

The components of an anode contact and locking assembly for the x-ray tube 1 in accordance with the principles of the present invention are shown in FIG. 2. The assembly includes a contact actuator 32 which is cylindrical and is conducted through an opening in the connecting element 10 of the x-ray tube 1. The contact actuator 32 has a flange or ring 33 by means of which the contact actuator 32 is connected air-tight to the connecting element 10 by a spring bellows 34. The contact actuator 32 is connected to an armature 35 of a magnetic actuator 36, such as a solenoid, disposed outside of the evacuated housing.

At its outer end facing away from the evacuated housing, the contact actuator 32 is attached to a cylindrical collar 37 having an exterior surface 39 proceeding parallel to the exterior surface of the contact actuator 32. The exterior surface 39 is seated in a cylindrical tube 38 to glide against the interior surface of the tube 38. The tube 38 is attached to the connecting element 10. A spring 40 is disposed between the connecting element 10 and the collar 37 which opposes the force acting on the contact element 32 produced by the pressure differential between the interior and exterior of the evacuated housing.

Figure 3:
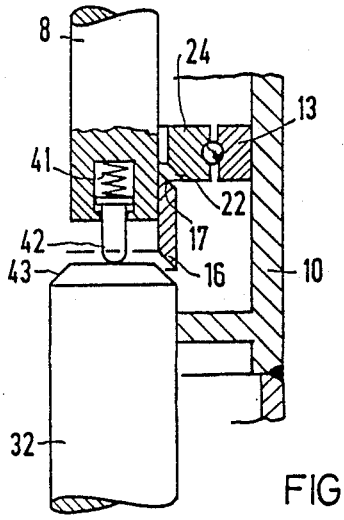
FIG. 3 is a side sectional view of a portion of the components shown in FIG. 2 in an unlocked condition.

When the solenoid 36 is energized, the armature 35 moves the contact actuator 32 into the evacuated housing to such an extent that, as shown in FIG. 3, an upper surface of the contact actuator 32 engages a contact pin 42, biased by a spring 41 and centrally attached at a lower end of the drive shaft 8, to close the anode contact so that the drive shaft 8 is connected to one pole of a high-voltage source (not shown) for operation. When the high-voltage is shut off, the solenoid 36 is simultaneously de-energized, so that the contact actuator 32 is displaced in the opposite direction and disengages the contact pin 42 as a result of the force generated by the spring 40. The voltage supply to the anode assembly 6 is thus interrupted.

The gliding surface 39 disposed outside of the evacuated housing permits the contact actuator 32 to be easily and reliably guided during displacement of the contact actuator 32, because the gliding surface 39 can be lubricated at any time from the exterior of the x-ray tube, so that the vacuum is not contaminated.

The end face of the contact actuator 32 projecting into the connecting element 10 of the x-ray tube 1 has a beveled surface 43 which can be moved into engagement with one slanted end of a ring 16 attached at the lower end of the drive shaft 8. The ring 16 projects slightly beyond the end face of the drive shaft 8. An opposite slanted surface of the ring 16 is disposed adjacent the beveled surface 22 of the inner race 24 of the mechanical bearing 13. This opposite end of the ring 16 serves as the beveled surface 17 in the normal operation of the mechanical bearing arrangement as described above.

A screw 45 acts on he collar 37 and is received in a threaded bore in an inwardly directed flange 44 attached to the tube 38. Rotation of the screw 45 adjusts the position of the contact actuator 32 in a direction toward the drive shaft 8 against the force of the spring 40. The drive shaft 8 is displaced by the beveled surface 43 and the slanting surfaces of the ring 16 so that the beveled surface 17 of the ring 16 is pressed against the beveled surface 22 of the inner ball race 24, thus maintaining the drive shaft 8 in firm contact with the connecting element 10, and centrally locking the drive shaft 8 in place. The drive shaft 8 is shown in such a locked condition in FIG. 2.

The assembly disclosed herein achieves at least two purposes. The first is that the gliding surface 39 of the anode contact assembly is disposed outside of the evacuated housing, and is thus always accessible for lubrication. Additionally, a safe transport of the x-ray tube 1 can be undertaken without damaging the anode assembly 6 due to movement of the anode assembly 6 within the housing 1.

Although modifications and changes may be suggested by those skilled in the art it is the intention of the inventor to embody within the patent warranted hereon all changes and modifications as reasonably and properly come within the scope of his contribution to the art.

I claim as my invention:

1. An x-ray tube for use with a high voltage supply, said x-ray tube comprising:

an evacuated housing;

a cathode disposed in said housing;

a rotatable anode having a drive shaft disposed in said housing, said drive shaft having a lower end in said housing;

a plurality of mechanical bearings disposed in said housing adjacent said drive shaft for supporting said drive shaft;

means for connecting said anode to said high voltage supply including a displaceable contact actuator having at least a portion thereof disposed in said evacuated housing, said contact actuator connected to said high voltage supply;

means for receiving said contact actuator in said evacuated housing air-tight;

means for displacing said contact actuator toward and away from said lower end of said drive shaft to make and break electrical contact therewith; and guide means attached to said contact actuator and disposed outside said evacuated housing for guiding movement of said contact actuator during displacement thereof.

2. An x-ray tube as claimed in claim 1, wherein said means for receiving said contact actuator in said evacuated housing air-tight is a spring bellows surrounding a portion of said contact actuator.

3. An x-ray tube as claimed in claim 1, wherein said guide means comprises:

a tube attached to the exterior of said x-ray tube surrounding said contact actuator and having an interior surface; and a cylindrical collar attached to a portion of said contact actuator outside of said evacuated housing, said collar having an exterior surface, and said tube also surrounding said collar with said interior surface of said tube and said exterior surface of said collar gliding against each other.

4. An x-ray tube as claimed in claim 1, further comprising:

locking means disposed outside of said evacuated housing for pressing said contact actuator firmly against said lower end of said drive shaft to substantially immobilize said drive shaft.

5. An x-ray tube as claimed in claim 4, wherein said locking means includes:

a ring disposed at said lower end of said drive shaft having a first slanted surface disposed adjacent one of said mechanical bearings, and a second slanted surface facing said contact actuator, said contact actuator having a correspondingly slanted surface adjacent said second slanted surface so that pressing said contact actuator against said second slanted surface presses said first slanted surface against said one of said mechanical bearings.

6. An x-ray tube as claimed in claim 1, further comprising:

a collar attached to said contact actuator and disposed outside of said evacuated housing; and a spring disposed between said evacuated housing and said collar acting on said collar and said contact actuator to oppose forces acting on said contact actuator from within said evacuated housing.

7. An x-ray tube as claimed in claim 6, further comprising locking means for pressing said contact actuator firmly against said lower end of said drive shaft to substantially immobilize said drive shaft, said locking means including:

a screw;

means for mounting said screw outside of said evacuated housing in contact with said collar such that rotation of said screw displaces said collar and said contact actuator toward said lower end of said drive shaft.

8. An x-ray tube as claimed in claim 7, wherein said means for mounting said screw is a tube attached to the exterior of said evacuated housing and wherein said collar is received in said tube, said tube having an inwardly disposed flange having a bore therein receiving said screw.

9. An x-ray tube as claimed in claim 1, further comprising:

a resiliently mounted contact pin disposed at said lower end of said drive shaft for engaging said contact actuator to make and break electrical contact therewith.

10. An x-ray tube for use with a high voltage supply, said x-ray tube comprising:

an evacuated housing;

a cathode disposed in said housing;

a rotating anode disposed in said housing and having a drive shaft, said drive shaft having a lower end;

a plurality of mechanical bearings disposed in said evacuated housing adjacent said drive shaft for supporting said drive shaft;

a contact actuator having a portion disposed inside said evacuated housing adjacent said lower end of said drive shaft, said contact actuator connected to said high voltage supply;

means for receiving said contact actuator in said evacuated housing air-tight;

means for displacing said contact actuator toward and away from said lower end of said drive shaft to make and break electrical contact therewith;

a tube attached to an exterior of said evacuated housing surrounding said contact actuator and having an interior surface;

a cylindrical collar attached to a portion of said contact actuator outside of said evacuated housing, said collar being received in said tube and having an exterior surface disposed to glide against said interior surface of said tube to guide said contact actuator during displacement thereof;

an inwardly extending flange attached to said tube; and a screw received in said flange and engaging said collar, rotation of said screw moving said collar and said contact actuator toward said lower end of said drive shaft to firmly press said contact actuator against said lower end of said drive shaft to substantially immobilize said drive shaft.

11. An x-ray tube as claimed in claim 10, further comprising:

a ring carried on said lower end of said drive shaft disposed between said contact actuator and one of said plurality of mechanical bearings so that movement of said contact actuator by rotation of said screw presses said contact actuator against said ring and thereby presses said ring against said one of said mechanical bearings.

12. An x-ray tube as claimed in claim 11, wherein said contact actuator has a beveled surface and wherein said one of said mechanical bearings has a beveled surface, and wherein said ring has opposite parallel slanted surfaces respectively disposed adjacent said beveled surface of said contact actuator and said beveled surface of said one of said mechanical bearings.

13. An x-ray tube as claimed in claim 10, further comprising:

a resiliently mounted contact pin disposed at said lower end of said drive shaft and engageable with said contact actuator to make and break electrical contact therewith.

* * * * *